US006306025B1

(12) United States Patent
Torii

(10) Patent No.: US 6,306,025 B1
(45) Date of Patent: Oct. 23, 2001

(54) DRESSING TOOL FOR THE SURFACE OF AN ABRASIVE CLOTH AND ITS PRODUCTION PROCESS

(75) Inventor: Kouji Torii, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/095,495

(22) Filed: Jun. 11, 1998

(30) Foreign Application Priority Data

Jun. 13, 1997 (JP) ..... 9-172871

(51) Int. Cl.[7] ..... B24B 21/18
(52) U.S. Cl. ..... 451/443; 451/56
(58) Field of Search ..... 451/36, 41, 56, 451/57, 65, 72, 443; 51/309

(56) References Cited

U.S. PATENT DOCUMENTS

| | | | | |
|---|---|---|---|---|
| 2,137,329 | * | 11/1938 | Boyer | 51/280 |
| 2,309,016 | * | 1/1943 | Ryan | 51/181 |
| 2,451,295 | * | 10/1948 | Metzger et al. | 51/209 |
| 4,931,069 | * | 6/1990 | Wiand | 51/293 |
| 4,974,373 | * | 12/1990 | Kawashima et al. | 51/295 |
| 5,049,165 | * | 9/1991 | Tselesin | 51/295 |
| 5,639,284 | * | 6/1997 | Ryoke et al. | 51/297 |
| 5,702,811 | * | 12/1997 | Ho et al. | 428/323 |
| 5,711,772 | * | 1/1998 | Ryoke et al. | 51/295 |
| 5,921,856 | * | 7/1999 | Zimmer | 451/539 |
| 5,976,205 | * | 11/1999 | Andrews et al. | 51/307 |

FOREIGN PATENT DOCUMENTS

| | | |
|---|---|---|
| 60-92406 | 5/1985 | (JP) . |
| 61-76273 | 4/1986 | (JP) . |
| 63-134173 | 6/1988 | (JP) . |
| 63-251170 | 10/1988 | (JP) . |
| 64-20969 | 1/1989 | (JP) . |
| 1-177974 | 7/1989 | (JP) . |
| 2-145261 | 6/1990 | (JP) . |
| 3-270876 | 12/1991 | (JP) . |
| 4-105875 | 4/1992 | (JP) . |
| 4-318198 | 11/1992 | (JP) . |
| 4-506634 | 11/1992 | (JP) . |
| 6-114739 | 4/1994 | (JP) . |
| 8-197432 | 8/1996 | (JP) . |

OTHER PUBLICATIONS

Abstract of JP4105875, Apr. 1992.*

*Solid State Technology*, Oct. 1994, pp. 66.

* cited by examiner

*Primary Examiner*—Timothy V. Eley
*Assistant Examiner*—Dung Van Nguyen
(74) *Attorney, Agent, or Firm*—Sughrue, Mion, Zinn, Macpeak & Seas, PLLC

(57) ABSTRACT

Onto the surface of a dressing tool for removing the clogging of an abrasive cloth, diamond grains of plural groups each having a different average particle diameter are subjected to be mixed and then fixed. In this state, the upper end of small diamond grains 4 is projected over nickel plating 2. Thereby foreign substances aggregated in the concave of the abrasive cloth are effectively removed and at the same time wearing the surface of the nickel plating 2 is prevented. Achieved are the stabilization of a polishing speed in polishing and the inhibition of dropping out diamond grains and wearing nickel plating in dressing.

18 Claims, 14 Drawing Sheets

FIG. 12 (a) PRIOR ART
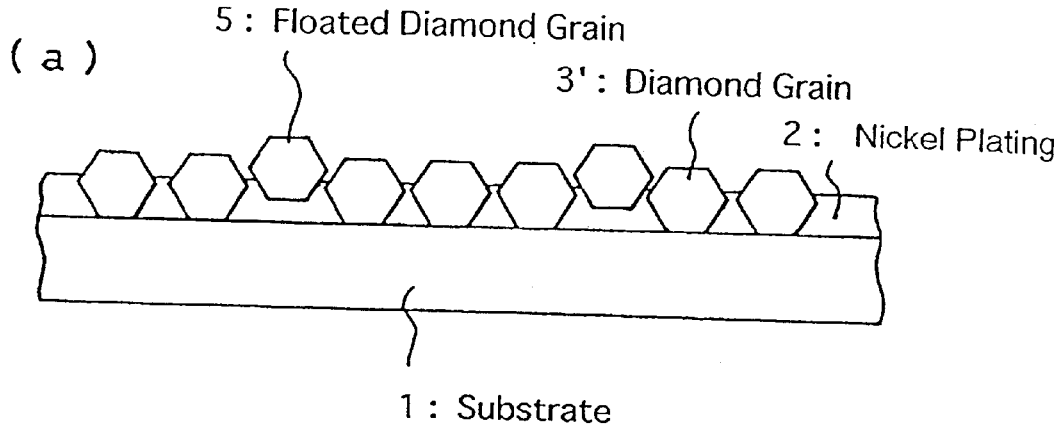
FIG. 12 (b) PRIOR ART
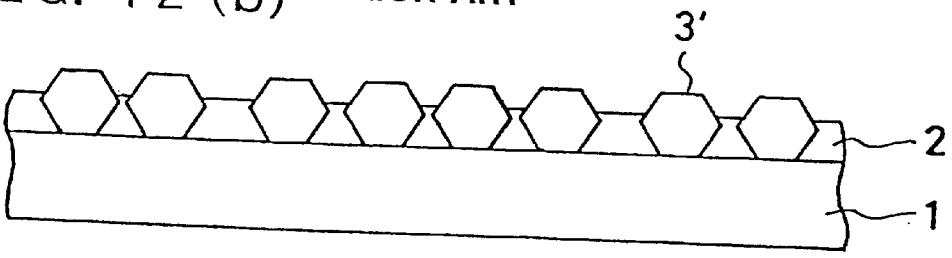
FIG. 12 (c) PRIOR ART
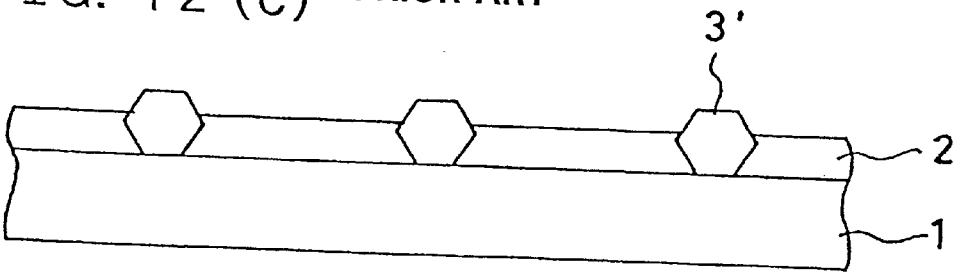

PRIOR ART
FIG. 14 (a)
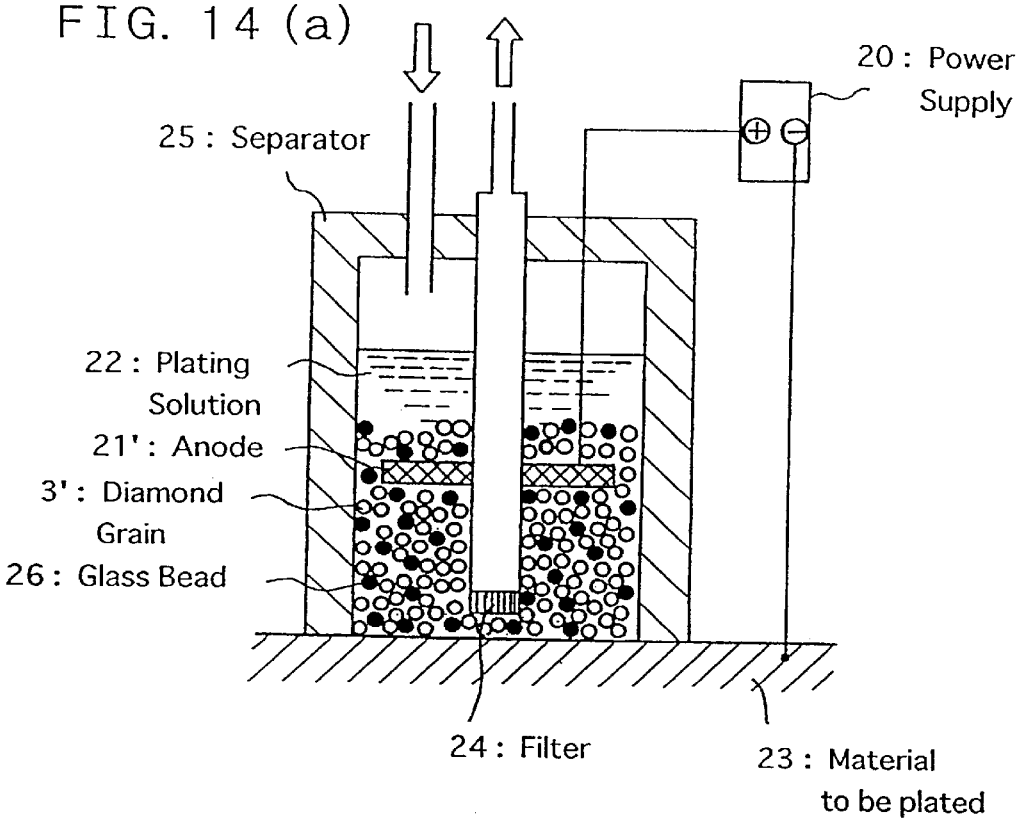
PRIOR ART
FIG. 14 (b)
PRIOR ART
FIG. 14 (c)
PRIOR ART
FIG. 14 (d)
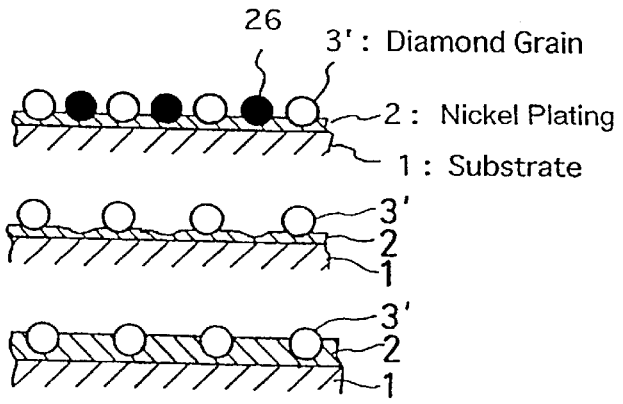

PRIOR ART
FIG. 15 (a)
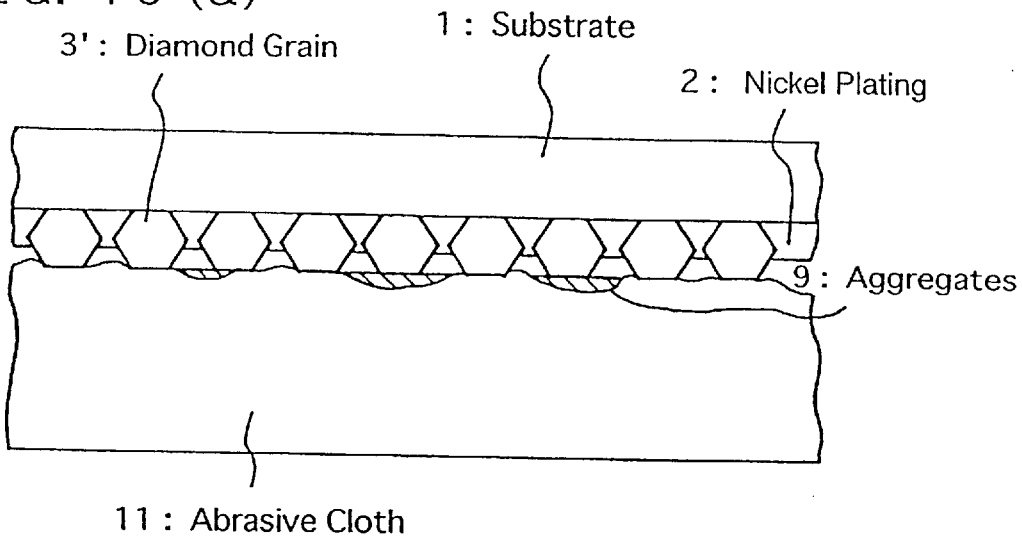
FIG. 15 (b) PRIOR ART
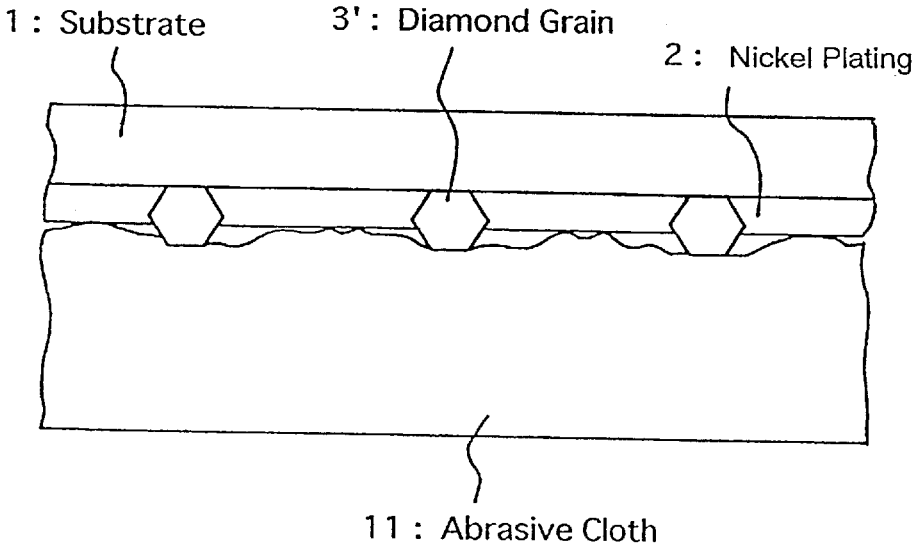

DRESSING TOOL FOR THE SURFACE OF AN ABRASIVE CLOTH AND ITS PRODUCTION PROCESS

FIELD OF THE INVENTION

The present invention relates to a dressing tool for the surface of an abrasive cloth, more particularly to a dressing tool for dressing the surface of a polishing cloth for use in a mechanochemical polishing process.

DISCUSSION ON THE RELATED ART

The following considerations have been by the inventors during their eager investigations toward the present invention on the conventional techniques.

Recently, the high integration of the semiconductor device, the focus margin of the exposing unit for transferring a pattern has gotten narrower and narrower so that the conventional flattening process of reflowing, coating such as Spin On Glass (SOG) coating or etching back is hard to provide for a wide range of flattening. In this respect, a Chemical Mechanical Polishing or mechanochemical polishing (hereinafter shortly referred to as "CMP") process for polishing a semiconductor substrate by mechanical and chemical actions has been mainly employed recently. A conventional polishing apparatus used in the CMP process will be explained below in reference to the accompanying drawings. FIG. 13 is a side view showing an essential part of the polishing apparatus. As shown in FIG. 13, this polishing apparatus includes a turn table 10 with a flattened, leveled surface. This table 10 has a diameter of around 50 to 100 cm and is made of a highly rigid material. On the surface of the table 10, an abrasive (polishing) cloth 11 of around 1 to 3 mm in thickness is affixed. The polishing apparatus further includes over the table 10 a carrier 13 of a size corresponding to the diameter of a semiconductor wafer 12 whose surface faces the face of the table 10 in parallel. The carrier 13 can be driven by means of a spindle 14. The polishing apparatus moreover includes near the table 10 a dressing mechanism 15 for recovering the surface of the abrasive cloth 11.

After providing the carrier 13 with the semiconductor wafer 12, the carrier 13 is made to be lowered onto the abrasive cloth 11, then to the semiconductor wafer 12 a load of around 300 to 600 g/cm$^2$ is applied while a polishing agent 16 is being supplied, and at the same time the table 10 and the carrier 13 are rotated to the same direction at around 20 to 50 rpm, thereby polishing is performed.

In the CMP process for an intercalative insulating film, as the abrasive cloth 11, for example, IC1000 (trademark of Rodel Co., Ltd., U.S.A.) of hard foamed polyurethane is generally used, and as the polishing agent 16, SC-1 (trademark of Cabot Co., Ltd., U.S.A.) basically containing fumed silica is used.

Polishing a semiconductor wafer by the same way as disclosed above, using these materials, causes phenomena that foams (pores), existing on the surface of the abrasive cloth 11 become clogged with the silica contained in the polishing agent so that a polishing rate becomes decreased.

For this reason, there has been put into practice a recovery treatment of the abrasive cloth 11 surface by means of the dressing mechanism 15 simultaneously or at given intervals with polishing the semiconductor wafer 12. Refer to, for example, Solid State Technology, October 1994, left column, line 2 to right column, line 9.

The dressing mechanism 15 generally includes a disk-like dressing tool onto which diamond grains are fixed by nickel plating, a dressing tool holder and a drive arm for moving the dressing tool on the abrasive cloth.

The work of the dressing mechanism 15 is to remove clogging from the surface of the abrasive cloth 11, and recover the surface roughness of the abrasive cloth 11 into the beginning state before polishing.

FIG. 16 is a graph showing the change of the polishing speed (or rate) in polishing a semiconductor wafer under insufficiently dressed conditions. The abscissa expresses the number of treated pieces, and the ordinate expresses the polishing speed (relative ratio). It is observed that under the insufficiently dressed conditions the polishing speed of the semiconductor wafer tends to decrease in proportion to the number of treated pieces, which causes a marked lowering of the productivity.

It is the most important in the CMP process to maintain a stable polishing speed stable, and in order to maintain this polishing stability the surface treatment of the abrasive cloth with the dressing mechanism is most effective. Especially, prominent effects are given by the dressing tool in terms of its surface roughness such as the intervals of the diamond grains and their grain sizes.

The following is the description of a conventional dressing tool. FIG. 12 illustrates the cross-sectional view of a conventional dressing tool. At first, FIG. 12 (a) shows that diamond grains 3' are embedded into nickel plating 2 and fixed so as not to be released. The diamond grains 3' generally used in the CMP process have an average particle diameter of around 120 to 240 $\mu$m, and the thickness of the nickel plating 2 is set to about 60 to 70% of the average particle diameter of the diamond grains.

In fixing diamond grains 3', sedimentation fixing and bag fixing methods are employed. In any of these methods, the diamond grains 3' are fixed onto all over the surface of a material to be fixed, thereby the diamond grains 5 floated from (i.e., floatingly retained by) a substrate 1 exist.

Such floated diamond grains 5 can be brought into contact with the interior of foams existing on the wavy surface of an abrasive cloth 11 so that aggregates of a polishing agent clogging the foams can be effectively removed.

However, the floated diamond grains 5 cause the problem that they are covered with nickel plating 2 in a ratio of not more than 50%, and accordingly, their retainability is low so that they are easily released out onto the surface of the abrasive cloth 11, consequently, unrecoverable scratches of several tens microns in depth are produced on the surface of the semiconductor wafer 12.

To this end, recently, as disclosed in, for example, Unexamined Japanese Patent Publication JP-A-4-318198 (1992 ) and etc., the floated diamond grains have been removed in the course of manufacturing. More concretely, there has been put into practice a process including steps of nickel plating in a vessel filled with diamond grains to develop first thin nickel plating, removing the floated diamond grains after taking out of the vessel, and then nickel plating in a vessel containing no dispersed diamond grains to develop second nickel plating until a total of the first and second nickel platings becomes the predetermined thickness.

By applying such a process as disclosed above, as shown in FIG. 12(*b*), an almost uniform surface with little floated diamond grains can be obtained. However, the dressing tool having such a uniform surface prevents the diamond grains from sufficiently making contact with the interior of the foamed body existing on the surface of the abrasive cloth so that the polishing speed becomes lowered.

FIG. 15 is a cross-sectional view showing the contact state of an abrasive cloth with a dressing tool. On account that the surface of the abrasive cloth 11 is waved and the abrasive cloth is considerably hard, for example, IC1000 (trademark of Rodel Co., Ltd.) has a hardness of around 60 (Shore D), when the diamond grains 3' are embedded so as to have nearly the same projection height and close intervals as shown in FIG. 15(*a*), a pressure becomes deconcentrated and biting-in of the diamond grains into the abrasive cloth is inhibited.

For this reason, it is preferable to decrease the number of the embedded diamond grains as shown in FIG. 15(*b*).

However, simple reduction of diamond grains to be fixed accompanies the poor reproducibility with respect to the embedded number and the extreme difficulty in arranging at equivalent intervals, though it may be effective for decreasing the number of the embedded diamond grains under the surface of the dressing tool.

To this end, for example, the aforementioned Japanese Patent Publication Kokai JP-A-4-318198 proposes to ultimately decrease the embedded number of the diamond grains by mixing at the time of fixing the diamond grains dummy particles such as glass beads or the like which can be removed later selectively. This production process will be explained below. FIG. 14(*a*) is a cross-sectional side view showing the constitution of a plating apparatus disclosed in the Japanese Patent Kokai JP-A-4-318198 for preparing a dressing tool.

As shown in FIG. 14(*a*), diamond grains 3' having a diameter of about 100 $\mu$m as abrasive grains are mixed with another particles of glass beads 26 having a diameter of about 100 $\mu$m 50% by 50%. As a plating solution 22, for example, Watt-type nickel-plating solution is used.

In opposition to a cathode surface having a limited plating portion, an anode 21' is disposed within a separator (vessel) 25. The abrasive grains and the plating solution are mixed beforehand. By stirring the abrasive grains near the surface of a material to be plated with a stirring rod, bubbles are removed from the surface of the material to be plated.

Subsequently, by the operation of a pump the plating solution 22 is alllowed to be circulated, thereby the diamond grains 3' and glass beads 26 are travelled near a filter 24, then accumulated near the lawer end of the filter 24, of on the bottom, pressed and fixed onto the surface of the material 23 to be plated, At the time this state has been stably established, plating is subfected to be stared.

By connecting the material 23 to be plated to the minus side of a power supply 20 and the anode to the plus side, plating is performed By this plating, the primary fixing step is completed when a deposit thickness of 10 to 20 $\mu$m is obtained.

After this step, the surface of the plated material 23 is water-washed, and unfixed diamond grains 3' with unfixed glass beads 26 are rendered to be dropped out as shown in FIG. 14(*b*).

After removing the remained grass beads 26 selectively as shown in FIG. 14(*c*), nickel plating is carried out in a solution with no abrasive grain until the diamond grains 3' are covered with plating up to around 60% of their diameters (FIG. 14(*d*)) to fix the diamond abrasive grains.

SUMMARY OF THE DISCLOSURE

Based on the investigations toward the present invention, the following problems have been encountered.

Namely, these conventional techniques disclosed above involve the following problems.

First of all, the dressing tool has a short life. This is considered due to the wear of the nickel plating resulting from contact with the abrasive cloth which is easily made since the abrasive cloth is a hard material but exhibits elasticity, and in addition, the diamond grains have wide intervals (i.e., loosely distributed).

Second, a serious metal (nickel) contamination of the abrasive cloth from the dressing tool is observed.

The present invention has been made in consideration of the above problems.

Accordingly, it is an object of the present invention to provide a dressing tool for the surface of an abrasive cloth which makes it possible to maintain the predetermined polishing speed stably and at the same time to inhibit the dropout of diamond grains as well as the wear of a nickel plating portion and the high-level nickel contamination, thereby to improve the reliability and the productivity of a semiconductor device.

It is another object of the present invention to provide a process for the production of the above featured dressing tool.

Further objects of the present invention will become apparent in the entire disclosure.

To attain the above object, there is provided a dressing tool according to one aspect of the present invention, for use in dressing the surface of an abrasive cloth in a mechanochemical polishing process for polishing a semiconductor wafer, essentially including diamond grains of an average diameter large enough to exhibit a dress action, and around these diamond grains other particles having an average diameter smaller than that of the diamond grains or a plate thinner than the diamond grains.

In another aspect of the present invention, there is provided a process for preparing a dressing tool for the surface of an abrasive cloth, which comprises steps of mixing diamond grains of plural groups each having a different average diameter, temporarily fixing the mixture onto a substrate, removing floated diamond grains which are not in contact with the substrate, and developing metal (preferably, nickel) plating to a predetermined plating thickness.

In a third aspect, there is provided another process for preparing a dressing tool for the surface of an abrasive cloth, which comprises steps of temporarily fixing diamond grains with other particles having an average diameter less than that of the diamond grains in mixture onto a substrate, removing floated diamond grains and other floated particles both of which are not in contact with the substrate, and developing metal (preferably, nickel) plating to a predetermined thickness.

In a fourth aspect, there is provided a still another process for preparing a dressing tool for the surface of an abrasive cloth, which comprises steps of opening holes through an insulator plate, adhering the plate to a substrate, and metal (preferably, nickel)-plating selectively on the substrate inside the holes through the plate to fix diamond grains to the substrate only inside the holes, with a proviso that the plate is never removed afterward (i.e., kept adhered to the substrate).

In a fifth aspect, there is provided a more specific process for preparing a dressing tool for dressing the surface of an abrasive cloth, which comprises steps of fixing diamond grains onto a substrate by metal (preferably, nickel) plating, and forming a protective layer on the resultant metal plating.

Explanation concerning the principle and operations distinctive of the present invention is given as follows. At first, by controlling the projecting diamond grains to have an appropriate distribution density (i.e., appropriate intervals), the projecting diamond grains are allowed to bite into the surface of the abrasive cloth to make it possible to remove aggregates of a polishing agent clogged in pores existing on the surface of the abrasive cloth.

Second, even after removing floated diamond grains developed in the course of fixing diamond grains, more than required level of surface roughness (waved state) is ensured for maintaining high dressing efficiency and at the same time inhibiting the dropout (release) of the diamond grains.

Moreover, by embedding the small diamond grains or other hard particles in terms of their average particle diameter into areas which don't directly take part in dressing, or otherwise by bringing the plate into contact with the above areas, direct contact of the surface of the abrasive cloth with metal (preferably nickel) plating is prevented so that it is made possible to inhibit severe wear of the metal plating and high-level metal contamination on the surface of the abrasive cloth.

As contrasted to the present invention, the serious metal (nickel) contamination in the conventional art has been caused by the contact of the metal plating part of the dressing tool to the abrasive cloth during the dressing.

PREFERRED EMBODIMENTS OF THE INVENTION

Preferred embodiments of the present invention will be explained below in reference to the accompanying drawings.

First Embodiment

Figure 1:
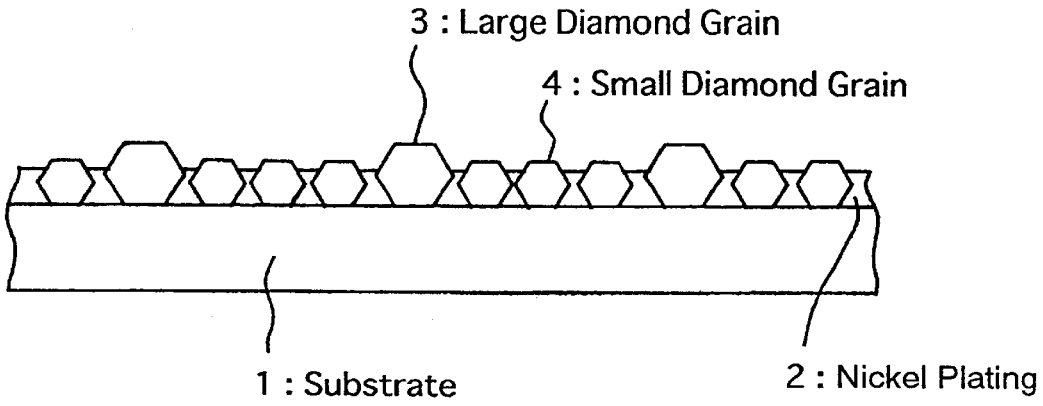
FIG. 1 Cross-sectional view showing an essential part of a dressing tool of a first embodiment of the present invention FIG. 2 Schematic side cross-sectional view showing a plating apparatus for use in preparing a dressing tool of the present invention FIGS. 3(*a*)–3(*c*) Schematic cross-sectional views showing essential steps for preparing a dressing tool of a first embodiment of the present invention FIG. 4 Schematic cross-sectional view illustratively showing the operation of a dressing tool of a first embodiment of the present invention FIG. 5 Graph demonstrating the effect of a dressing tool of the present invention FIG. 6 Graph demonstrating the effect of a dressing tool of the present invention FIG. 7 Graphs demonstrating the effect of an exemplary dressing tool of the present invention FIGS. 8(*a*)–8(*b*) Graph 5 demonstrating the effect of an exemplary dressing tool of the present invention FIG. 9 Cross-sectional view showing an essential part of a dressing tool of a second embodiment of the present invention FIG. 10 Cross-sectional view showing an essential part of a modified dressing tool of a second embodiment of the present invention FIG. 11 Cross-sectional view showing an essential part of another modified of a second embodiment of the present invention FIGS. 12(*a*) –12(*c*) Cross-sectional view showing essential part of a conventional dressing tool FIG. 13 Schematic view showing essentially the constitution of a polishing apparatus associated with the present invention FIG. 14 Schematic cross-sectional view for explaining a conventional art of dressing tool constitution, production process and steps thereof FIGS. 15(*a*)–15(*b*) Schematic cross-sectional view illustratively showing the operation of a conventional dressing tool FIG. 16 Graph demonstrating the defects of a conventional dressing tool

In a first embodiment of the present invention, as shown in FIG. 1, diamond grains of two or more groups classified in terms of an average particle diameter are fixed in mixture, and the upper end of small diamond grains 4 are also projected over nickel plating 2.

Desirably, in the mixture of the diamond grains, the number of large diamond grains 3 is equal to or less than the small diamond grains 4. Preferably, the number of the small grains is 2 to 20, or further 5 to 15, relative to the number "1 " of the large grains. Preferably, the large diamond grains 3 have diameters of 100 to 300 $\mu$m, and small diamond grains 4 have 60 to 80% of the diameter of the large diamond grains 3.

Preferable thickness of the nickel plating 2 is 50 to 70% of the diameter of the large diamond grains 3.

Figure 2:
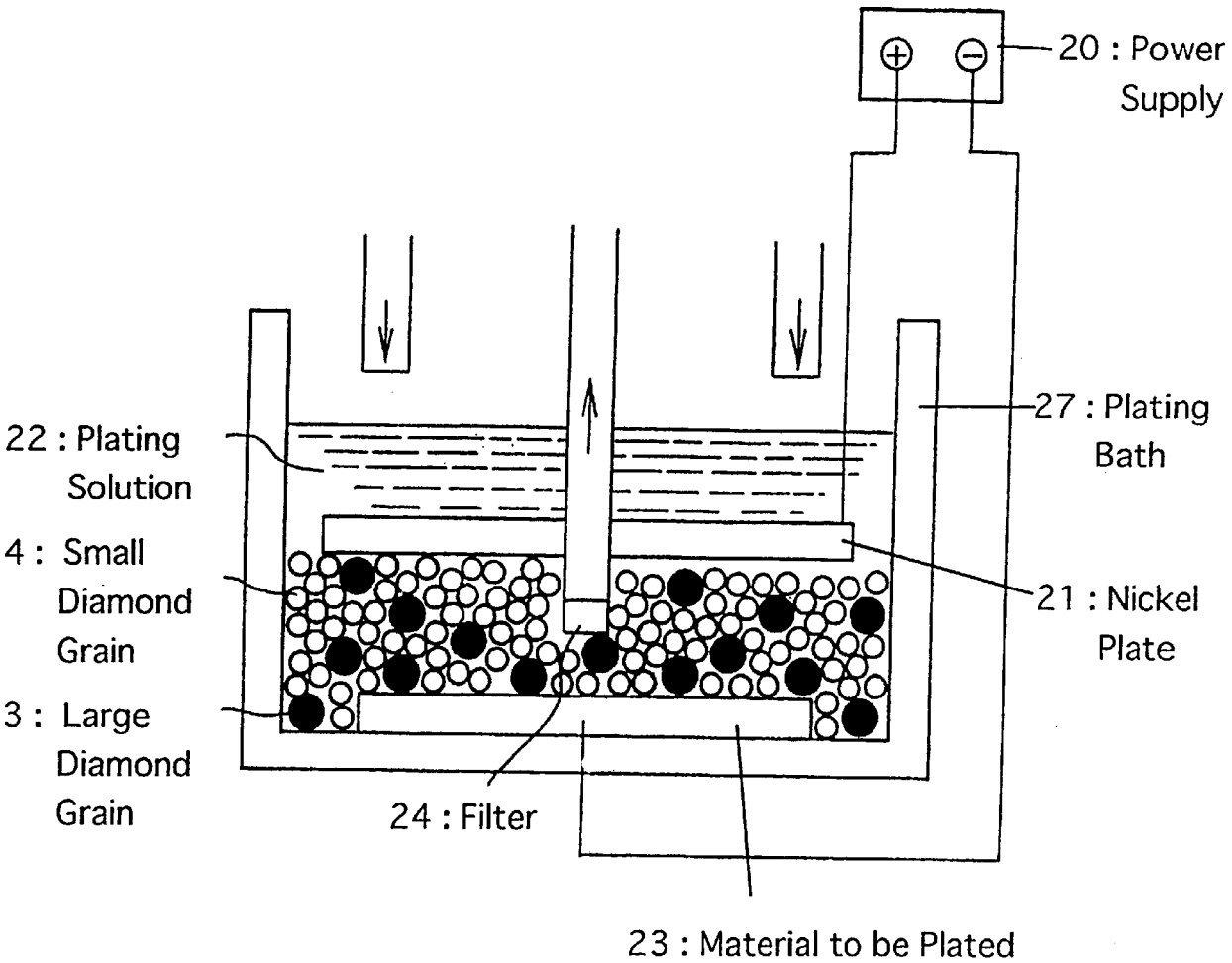

FIG. 2 shows a plating apparatus for use in preparing a dressing tool of the present invention for dressing the surface of an abrasive cloth.

The large and small diamond grains premixed in the predetermined ratio are diffused into a plating solution and stirred enough to mix the large and small diamonds uniformly. The diamond may be natural or synthetic.

Next, a material 23 to be plated is disposed at the bottom of a plating apparatus and connected to a cathode of a power supply 20. A nickel plate 21 is provided above the material 23 to be plated and connected to an anode of the power supply 20.

Diamond grains are supplied in the form of a dispersion and allowed to be dropped and accumulated on the surface of the material 23 to be plated to cover the whole surface of the material 23 to be plated with the diamond grains. At the same time, a nickel-plating solution 22 is supplied to a predetermined level. A Watt-type nickel-plating solution or another plating solution may be used here.

After running current from the power supply 20 to form nickel plating of 10 to 20 $\mu$m, the deposited material 23 is taken out and then water-washed. In the midst of plating, the plating solution is subjected to circulation and filtered sufficiently through a filter.

Figure 3:
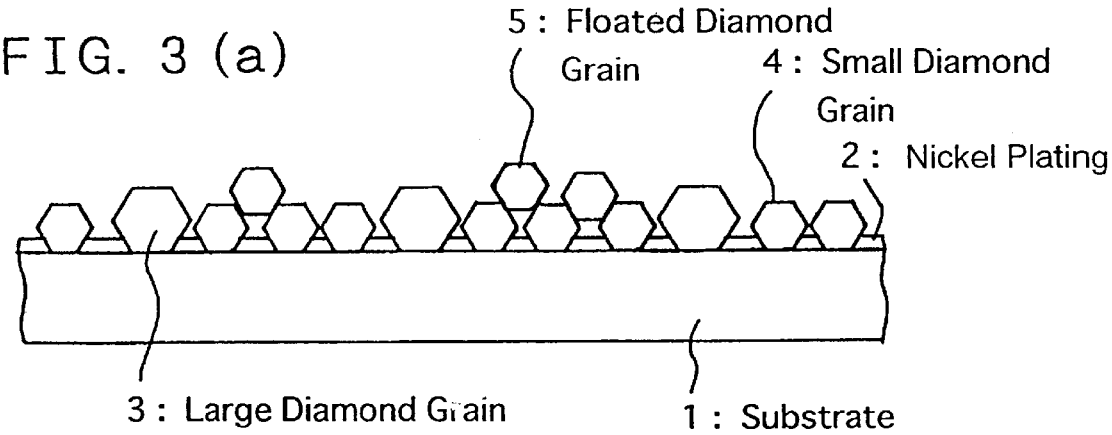
Figure 3:
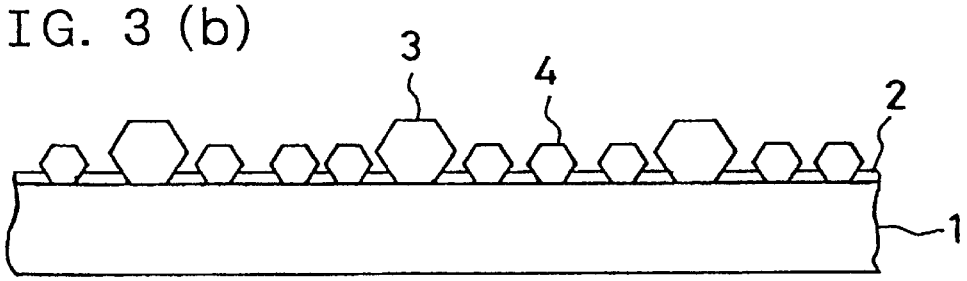
Figure 3:
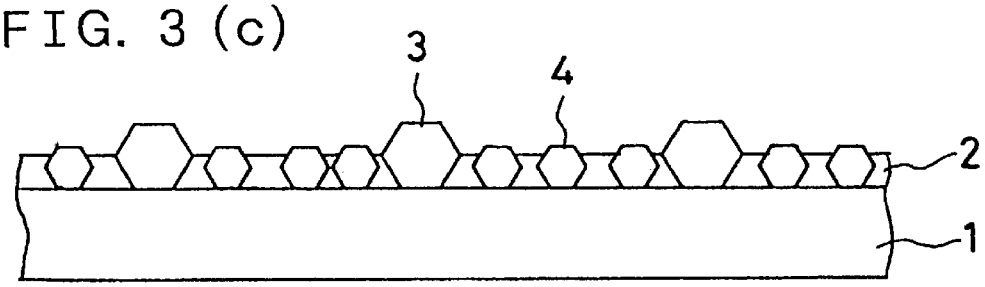

FIG. 3 shows subsequent preparing steps. As shown in FIG. 3(*a*), after the above first fixing, floated diamond grains 5 are bestrewed. These floated diamond grains are mechanically removed with grinding wheel or the like as shown in FIG. 3(*b*). Subsequently, in a plating bath containing no diamond grain, nickel plating is developed to a thickness corresponding to 50 to 70% of the large diamond grain size.

Figure 13:
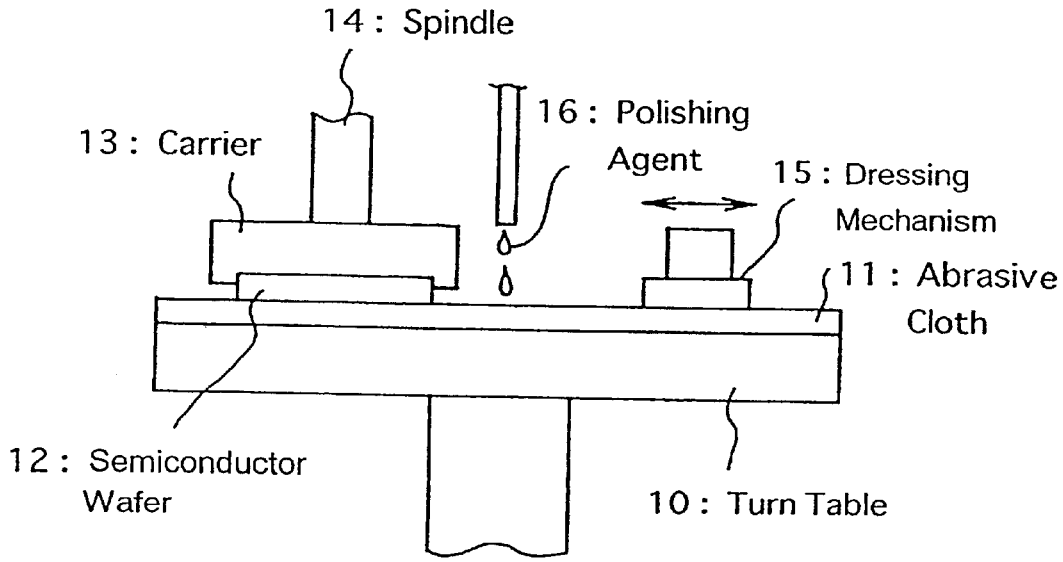
PRIOR ART FIG. 13
Figure 16:
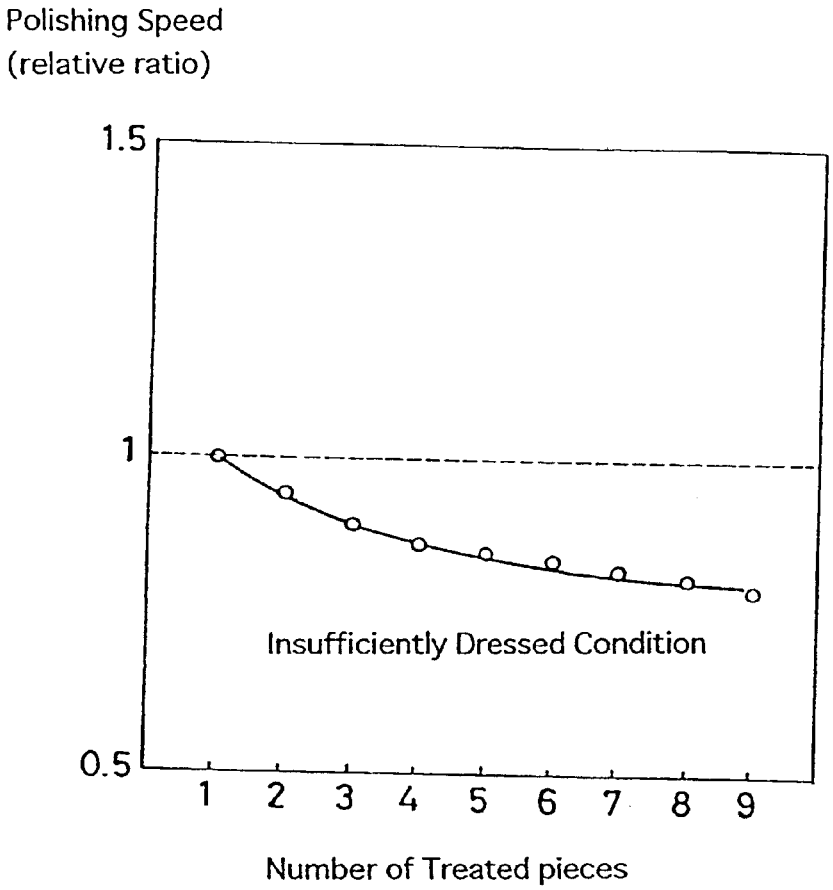
FIG. 16 PRIOR ART

The performance of the dressing tool of the first embodiment of the present invention will be explained more in detail in reference to FIG. 13. FIG. 13 is a schematic view of a polishing apparatus. As to the constitution and mechanism of the polishing apparatus, explanation has been made in the introductory part of "Discussion on the Related Art", and therefore is omitted here.

A dressing tool holder installed in the polishing apparatus is provided with a dressing tool. Dressing processes with this dressing tool are classified into two groups from the following aspects: one aspect is to dress in the interval of polishing; and another aspect is to dress simultaneously to with polishing.

The following is the explanation of the dressing process in the interval of polishing. Rotating the turn table 10 and carrier 13 under supply of a polishing agent 16, polishing proceeds by applying load to the carrier 13. The change in the polishing speed during this process is shown in FIG. 5.

Figure 5:
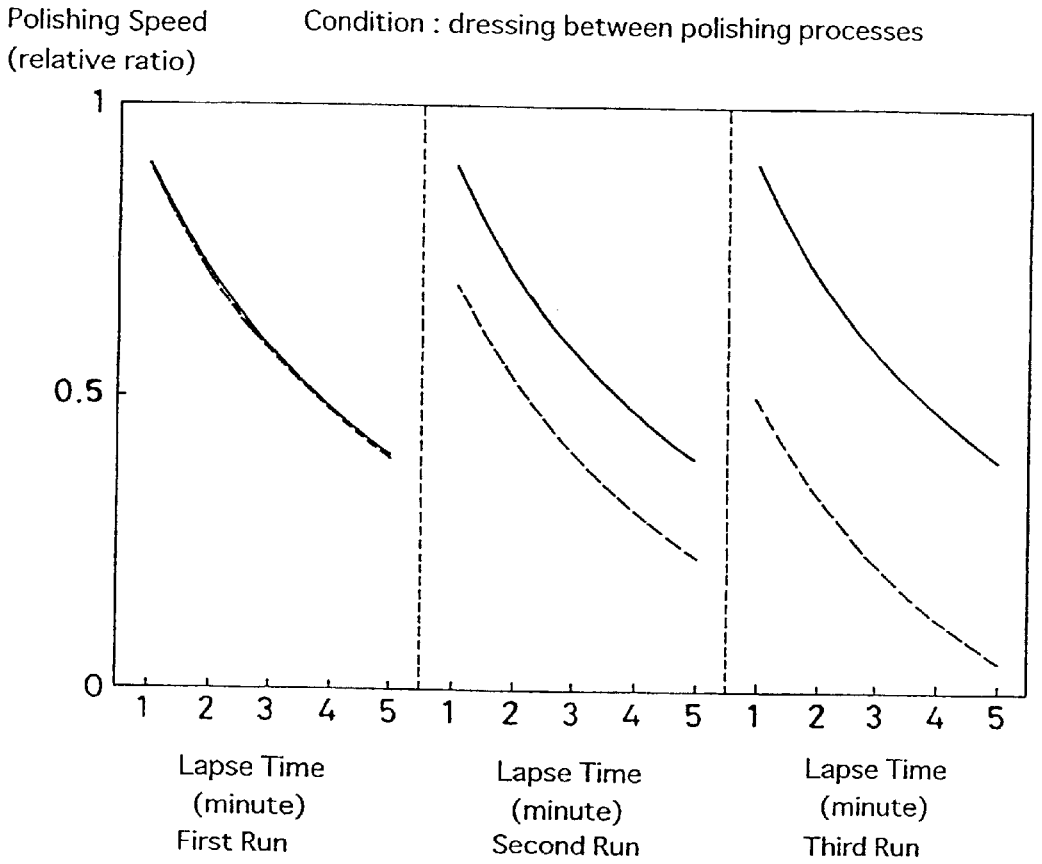

FIG. 5 shows the polishing speed, in case of polishing a silicon oxide layer using a fumed-silica slurry of SC-1 (trademark of Cabot Co., Ltd.) as a polishing agent, which decreases with lapse of time. As explained in the paragraph of "Discussion on the Related Art", this is due to the clogging of fine pores existing on the surface of an abrasive cloth by the polishing agent.

After polishing a piece of semiconductor wafer, a dressing tool of the present invention is pressed onto the surface of the abrasive cloth while rotating. At the same time, the turn table is rotated so that the entire surface of the abrasive cloth can be treated. In the course of dressing, water or a polishing agent is supplied for washing out foreign substances removed from the pores. By dressing in this way, as shown in FIG. 5 by solid line, stable polishing speed can be obtained even after repetition of treatments.

On the other hand, a conventional dressing tool, which only serves to remove floated abrasive grains solely, tends to exhibit decrease of a polishing rate in proportion to the repetition number of treatments as shown in FIG. 5 by broken line.

Figure 4:
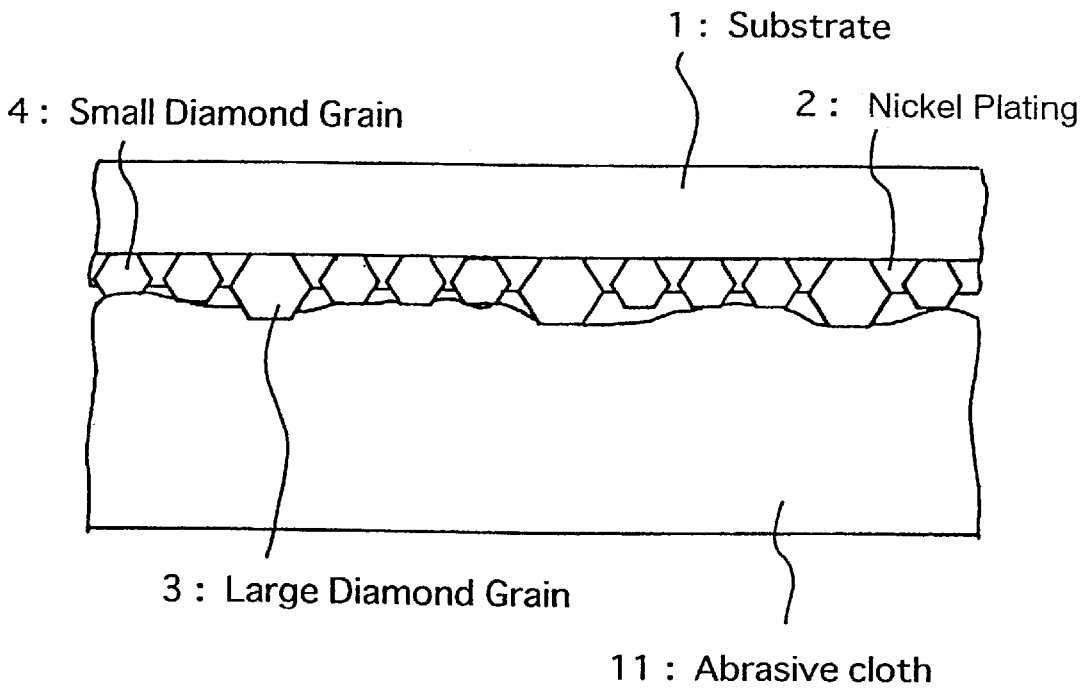

FIG. 4 shows the contacting state of a dressing tool with an abrasive cloth in connection with the first embodiment of the present invention. As can be seen from FIG. 4, according to the first embodiment of the present invention, diamond grains of different sizes are arranged on the surface of a dressing tool in mixture, whereby they easily reach the interior of concaves existing on the surface of the abrasive cloth, and consequently, make it possible to remove clogging easily.

Moreover, small diamond grains 4, which do not serve for dressing, are projected over nickel plating 2, and consequently inhibit the nickel plating 2 from wearing.

Figure 6:
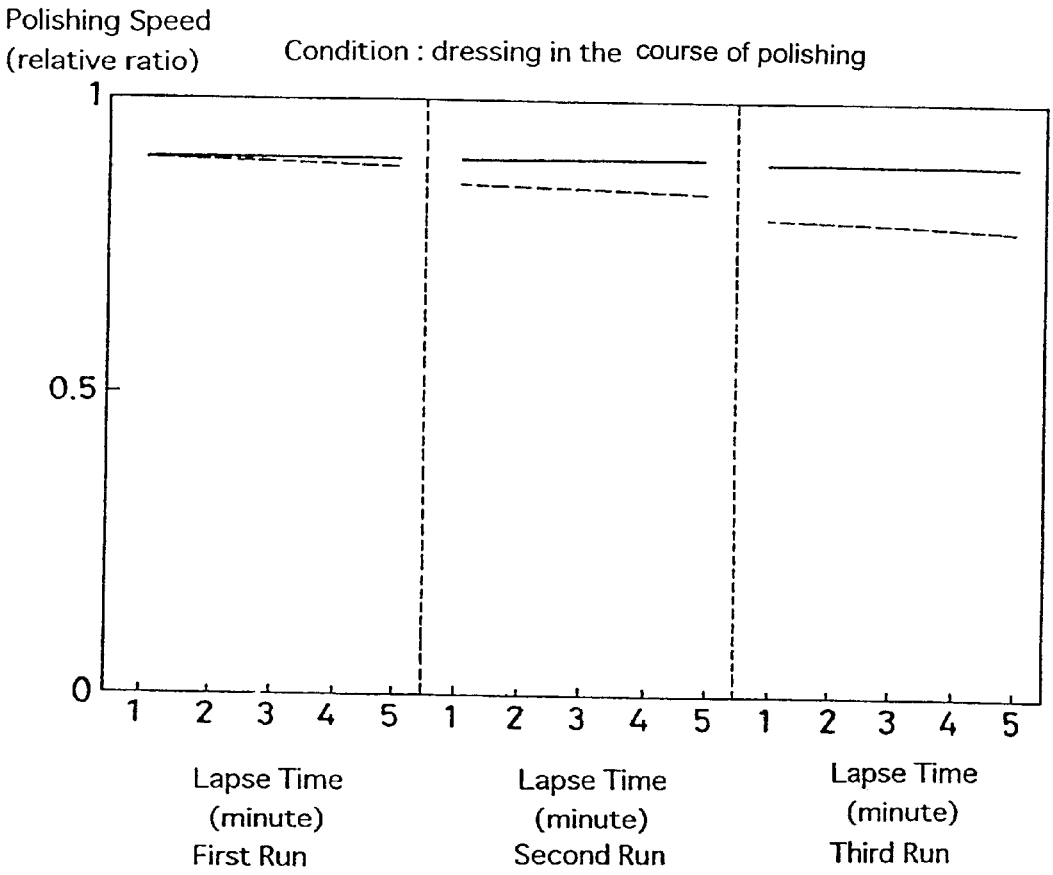

FIG. 6 shows the change of the polishing rate when polishing and dressing are carried out simultaneously. The polishing conditions are the same as those for obtaining the result shown in FIG. 5. Due to the synchronous polishing and dressing, rapid lowering of the polishing speed does not occur, however, a conventional dressing tool exhibits gradual lowering of the polishing speed in proportion to the repetition of treatments. In contrast, a dressing tool of the first embodiment of the present invention makes it possible to maintain nearly a constant polishing speed.

EXAMPLES

The present invention will be explained more in detail by the following examples in reference to the accompanying drawings.

FIG. 1 shows an exemplary dressing tool of the present invention. In this dressing tool, a disk substrate made of nickel alloy having a thickness of 2 mm and an outer diameter of 100 mm was provided with diamond grains having an average grain size of 180 $\mu$m and another group of diamond grains having an average grain size of 130 $\mu$m mixed in a ratio of 1:10. This mixing ratio was determined by filling a vessel having a unit volume with each group of diamond grains and estimated by the volume ratio of the resultant volumes. As a result, actual mixing ratio of diamond grains should be higher than the above mixing ratio. Then, the thickness of nickel plating was 110 $\mu$m.

FIG. 2 shows a plating apparatus for use in preparing the exemplary dressing tool of the present invention. In a plating solution diamond grains having an average grain size of 180 $\mu$m and another group of diamond grains having an average grain size of 130 $\mu$m were mixed in a ratio of 1:10. The following mixing ratio is a ratio when the amount of diamond grains filled into 50 ml of, for example, a vessel is denoted by "I". As the plating solution, Watt-type plating solution including 240 g/I of nickel sulfate, 45 g/I of nickel chloride and 30 g/I of boric acid was used. The plating solution was adjusted to pH of 4.5. Another plating solution including, for example, sulfamic acid, nickel chloride and boric acid may be used in place of the above plating solution.

A material 23 to be plated was disposed at the bottom of a plating apparatus and connected to the cathode of a power supply 20. A nickel plate 21 was positioned at distance above the material 23 to be plated and connected to the anode of the power supply 20. Voltage was then applied afterward.

The mixture of the diamond grains and the plating solution was supplied into the plating apparatus and then sufficiently stirred. Sometime later, on the surface of the material 23 to be plated, the diamond grains were accumulated by sedimentation. Then, a bath temperature was set at 43° C. and plating was performed at a current density of 5 A/dm$^2$ for 60 minutes. In the course of plating, the plating solution was circulated. After plating, the plated material was taken out and then water-washed. Floated diamond grains were removed from the plated material with a grinding wheel. Subsequently, on the plated surface of the plated material, plating was performed in a plating solution containing no diamond grain at a current density of 5 A/dm$^2$ for 60 minutes to form a plating layer having a thickness of 110 $\mu$m.

Now, the performance of the above exemplified dressing tool of the present invention will be explained more in detail with reference to FIG. 13. FIG. 13 shows a schematic view of a polishing apparatus.

Dressing was performed in the interval of polishing. As an object to be polished a silicon dioxide layer was used. An abrasive cloth of IC1000 (trademark of Rodel Co., Ltd.) made of foamed polyurethane and a polishing agent of SC-1 (trademark of Cabot Co., Ltd.) essentially including fumed silica were used in this example.

Polishing conditions were as follows:

| | |
|---|---|
| load applied to a carrier 13 | 500 g/cm2 |
| rotation of the carrier | 27 rpm |
| rotation of a turn table 10 | 25 rpm |
| supply of a polishing agent 16 | 200 ml/min. |
| polishing time | 5 min. |

After polishing, load was applied to the surface of the abrasive cloth through the dressing tool while the dressing tool was rotating. The rotation of the table may be 25 rpm. The load applied to the dressing tool was set 5 kgf.

By sliding (swinging) the dressing tool back and forth along the radial direction of the abrasive cloth, the whole surface of the abrasive cloth was treated.

Figure 7:
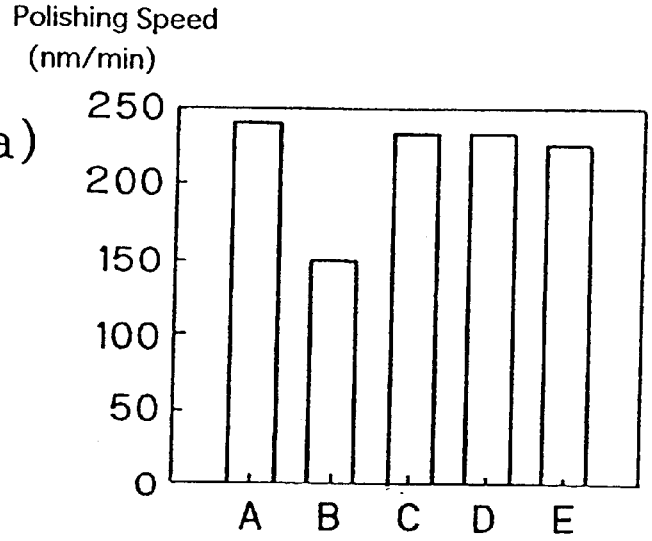
Figure 7:
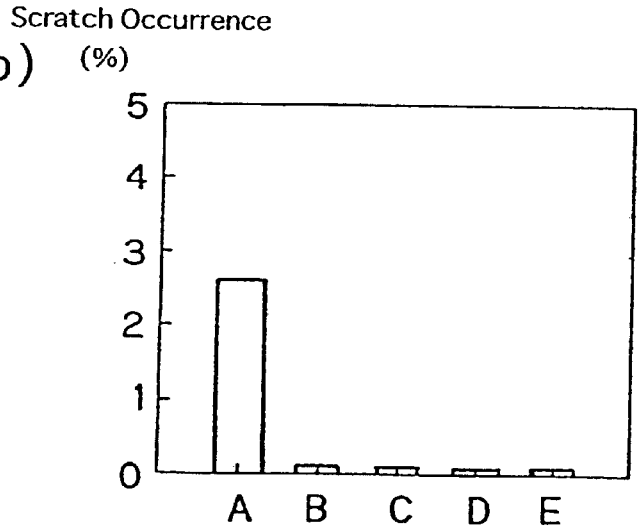
Figure 7:
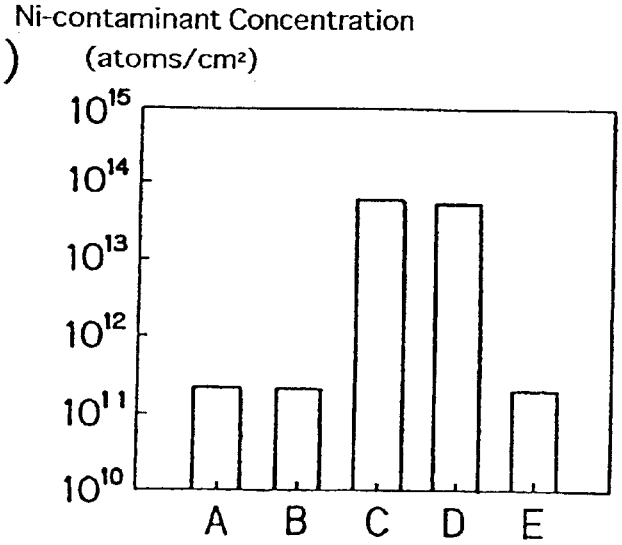
Figure 8A:
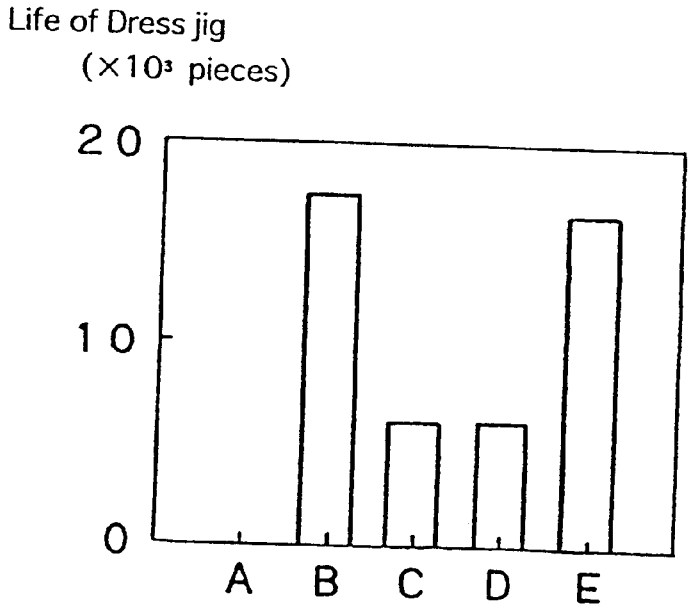
Figure 8B:
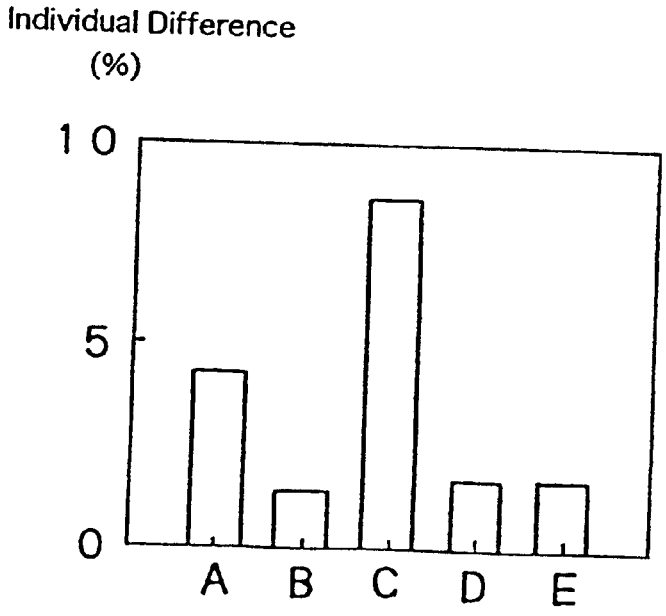

FIGS. 7 and 8 show the comparison results of various characteristics concerning the exemplified dressing tool of the present invention with those concerning a conventional dressing tool. FIGS. 7 and 8 are only the result of division for the convenience of drawing space.

In these figures, mark "A" represents the result regarding a comparative dressing tool prepared by a process including steps of fixing diamond grains having an average particle diameter of 180 μm to the whole surface of a disk substrate of 100 mm in diameter. In this dressing tool, floated diamond grains were not removed, and the thickness of nickel plating was 110 μm.

Mark "B" represents the result regarding a comparative dressing tool prepared by the same process regarding the mark "A" except removing the floated diamond grains with a grinding wheel.

Mark "C" represents the result regarding a comparative dressing tool prepared by a process comprising a step of widening the intervals (distances) between diamond grains fixed on the surface of a substrate simply by decreasing supply of diamond grains in the course of fixing the diamond grains onto the substrate.

Mark "D" represents the result regarding a comparative dressing tool prepared by the same process as disclosed in the paragraph of "Discussion on the Related Art" including steps of mixing diamond grains and glass beads, temporarily fixing the mixture onto a substrate, then removing glass beads to widen the intervals of diamond grains fixed on the substrate. In this dressing tool, the average particle diameters of the diamond grains and glass beads were 180 μm and 200 μm, respectively, the mixing ratio of the diamond grains to the glass beads was 1:10 and the thickness of nickel plating was 110 μm.

Mark "E" represents the result regarding an exemplary dressing tool of the present invention in which diamond grains having an average particle diameter of 180 μm and another group of diamond grains having an average particle diameter of 130 μm were mixed in a ratio of 1:10 and the thickness of nickel plating was 110 μm.

FIG. 7(*a*) shows the polishing speed obtained under the aforementioned polishing conditions. As shown in the result of the mask "B", satisfactory polishing speed could not be obtained simply by removing the floated diamond grains. The result of the mark "E" indicates that satisfactory polishing speed can be obtained according to the present invention.

FIG. 7(*b*) shows a scratch occurrence caused by the dropout of the diamond grains onto the abrasive cloth. As shown in the result of the mark "B", the scratch occurrence became remarkably high when no floated diamond grain had been removed. In contrast, removing the floated diamond grains, including the result of "E" regarding the exemplary dressing tool of the present invention, made it possible to control the scratch occurrence satisfactorily low.

FIG. 7(*c*) shows the concentration of nickel contaminants developed on the surface of the abrasive cloth in the course of dressing. As shown in the result of the marks "C" and "D", when a high percentage of nickel plating had been exposed around the diamond grains, nickel contaminants having high concentration of not less than $10^{13}$ atoms/cm$^2$ was detected. In this contrast, the result of "E" indicates that in the exemplary dressing tool of the present invention, nickel contaminant concentration can be controlled sufficiently low on account that the abrasive cloth scarcely comes into contact with the nickel plating. However, some contamination due to the dissolution of the nickel plating into the polishing solution was observed.

FIG. 8(*a*) shows a life of dressing tool. As shown in the result of the mark "E", the exemplary dressing tool of the present invention exhibited a long life. This should be owing to the protection of the nickel plating by the diamond grains. Here, the life was estimated by the number of treatments corresponding to the predetermined scratch occurrence. This scratch occurrence was 1% in this estimation.

FIG. 8(*b*) shows an individual difference of dressing tool. This was estimated by the ratio of the difference between the highest and lowest polishing speeds to an average polishing speed of 5 polishing speeds determined by a polishing test performed under the same conditions by using 5 dressing tool prepared every mark of "a" to "E". The individual difference was estimated small among the exemplary dressing tool of the present invention.

As being clear from the above, a dressing tool of the present invention makes it possible to overcome various defects of a conventional dressing tool, and has the advantages of making it possible to ensure more than required polishing speed and long life as well as to inhibit the scratch, high-level nickel contamination and difference in dressing tools.

Second Embodiment

Now, a second embodiment of the present invention will be explained below in reference to the accompanying drawings.

Figure 9:
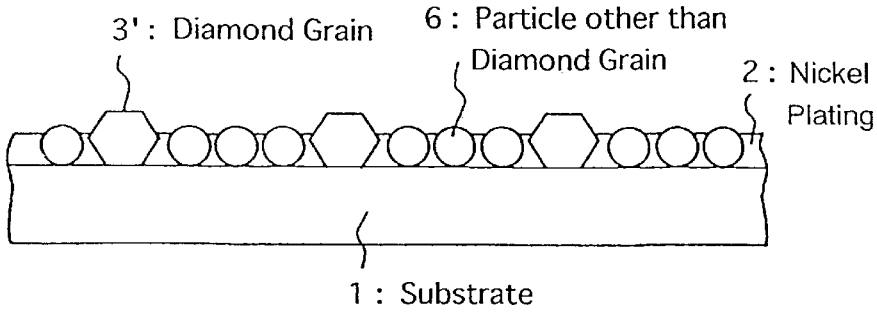

FIG. 9 shows a second embodiment of a dressing tool of the present invention. This dressing tool essentially has a mixture of fixed diamond grains 3' having a predetermined average diameter with other fixed particles 6, smaller than the diamond grains, the upper end of which is projected over nickel plating 2.

Materials of the other particles include $ZrO_2$, $Al_2O_3$, $Si_3N_4$, cubic boron nitride or ceramics, and hard plastics such as polyacetals (Delrin of DuPont), PET, polyester (Teflon) and polyurethane.

The production process of the second embodiment of the dressing tool of the present invention has the same steps of the first embodiment disclosed above. Namely, it includes steps of mixing the particles at the predetermined ratio, developing first thin plating, removing the floated particles and building up second plating to form an ultimate nickel plating layer having a predetermined thickness in total. Conditions such as the mixing ratio of the particles may be the same as those of the first embodiment.

Figure 10:
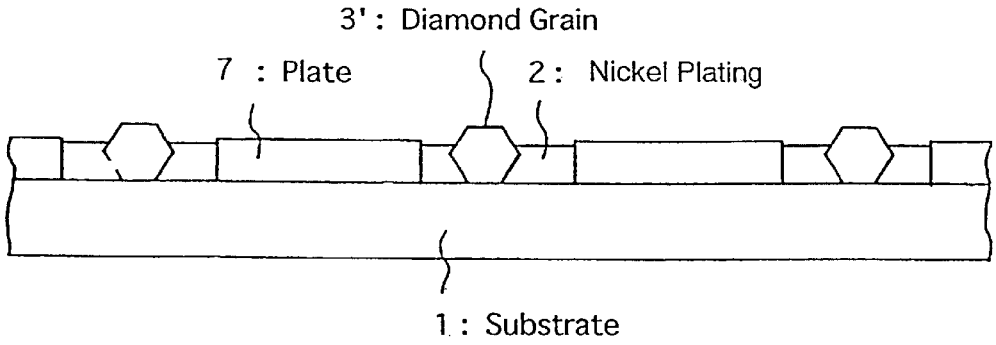
Figure 11:
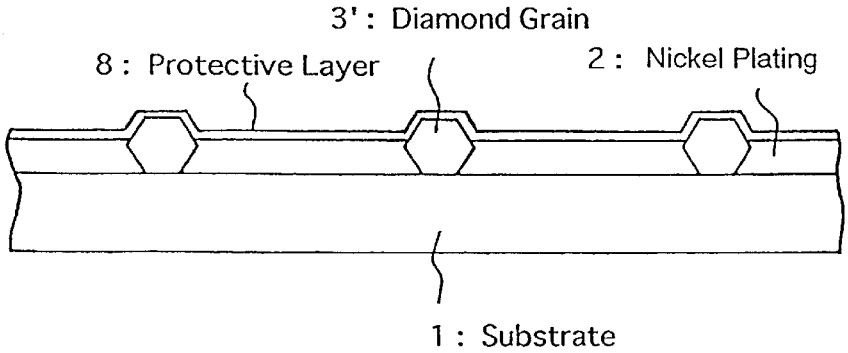

Modified second embodiments are exemplarily shown in FIGS. 10 and 11.

FIG. 10 shows an example in which a plate 7 is arranged around diamond grains 3' of the predetermined grain size.

Materials of the plate 7 include $ZrO_2$, $Al_2O_3$, $Si_3N_4$, cubic boron nitride, hard plastics such as Delrin.

The diamond grains 3' are apart from each other at constant intervals predetermined by the plate 7 and fixed locally by nickel plating 2. The thickness of the nickel plating 2 is 50 to 70% of the diamond grain 3' size and thinner than that of the plate 7. The size of holes provided through the plate 7 is about 1.5 to 2 times as large as the average size of the diamond grains 3', and the pitch of adjacent holes is 2 to 3 times as large as the average size of the diamond grains 3'.

A process for preparing the above modified embodiment of the dressing tool of the present invention includes the following steps. Through the plate the holes are opened mechanically or by means of laser processing. The position of the holes may be as stated above.

To a substrate 1 made of, for example, nickel alloy or stainless steel, the above plate 7 is adhered. The diamond grains 3' are temporarily fixed by first plating. In the modified embodiment single sort of diamond grains may be used. Floated diamond grains, if they exist in the worst case, should be removed. Then, a second plating is performed to form an ultimate nickel plating layers 2 until a predetermined thickness is obtained. The plate 7 is insulative so that nickel plating is never deposited on the plate, whereby only onto the inside of the holes diamond grains may be fixed.

FIG. 11 is a cross-sectional view showing a second modified embodiment of a dressing tool of the present invention. In this dressing tool, on the surface of nickel plating 2 a protective layer 8 is attached. Materials of the protective layer 8 include $ZrO_2$, $Al_2O_3$, $Si_3N_4$, cubic boron nitride, pseudo-diamond carbon, diamond and the like. The thickness of the protective layer 8 may be nearly 5 to 30 $\mu$m.

A process for preparing the above second modified dressing tool of the present invention includes the following steps. After admixing diamond grains with other particles and then temporarily fixing the diamond grains with first plating, the residual particles are selectively removed in the same manner as that of the conventional process for preparing a dressing tool. Subsequently, second plating is performed to develop an ultimate nickel plating layer 2 until a predetermined thickness is obtained. Then, not less than 10 $\mu$m of the protective layer, for example, $Al_2O_3$, layer is formed by ion plating. Another protective layer in place of $Al_2O_3$ layer may be formed by applying CVD or PVD process.

The meritorious effects of the present invention are summarized as follows.

As disclosed above, the present invention provides more than required polishing speed stably as well as makes it possible to inhibit the dropout of the diamond grains, the wear of the nickel plating and the nickel contamination of the abrasive cloth, thereby exhibits the effect of improving the productivity and reliance of a semiconductor device.

This is due to widening the intervals between the diamond grains achieved by the present invention, which makes it possible to make the diamond grains which are active for dressing easily contact with even deep portion of concaves existing on the surface of the abrasive cloth. Moreover, the portion which does not take part in polishing is provided with a protector for preventing the nickel plating from coming directly into contact with the abrasive cloth.

The present invention has been disclosed based on use of diamond abrasive as the large diamond grains. However other superabrasives such as CBN etc. may be used alone or in combination with diamond or other grains.

Various aspects, embodiments and any features or elements thereof may be combined together according to the gist of the present invention. Also it should be noted any modifications may be introduced within the gist and scope of the present invention herein disclosed and claimed as appended.

What is claimed is:

1. A polishing system comprising:

an abrasive cloth; and a dressing tool for dressing the abrasive cloth;

wherein the dressing tool includes a substrate, diamond grains disposed on said substrate, and particles disposed on said substrate around said diamond grains and having an average particle diameter smaller than an average diameter of said diamond grains.

2. The polishing system as defined in claim 1, wherein said particles are made of material other than diamond.

3. The polishing system as defined in claim 2, wherein said particles comprise at least one selected from the group consisting of $ZrO_2$, $Al_2O_3$, $Si_3N_4$, cubic boron nitride and hard plastics.

4. The polishing system as defined in claim 1, wherein said particles having the average particle diameter smaller than that of the diamond grains have particle sizes larger than the thickness of a metal binder.

5. The polishing system as defined in claim 1, wherein said diamond grains have their top points disposed higher above said substrate than top points of said smaller diameter particles.

6. A dressing tool for dressing a surface of an abrasive cloth, said dressing tool comprising:

a substrate;

diamond grains disposed on said substrate; and particles, disposed on said substrate around said diamond grains, said particles having an average particle diameter smaller than an average diameter of said diamond grains, wherein said particles are made of diamond.

7. The dressing tool for the surface of an abrasive cloth as defined in claim 6, wherein said diamond grains have their top points disposed higher above said substrate than top points of said smaller diameter particles.

8. A process for preparing a dressing tool for the surface of an abrasive cloth for use in a mechanochemical polishing process for polishing a semiconductor wafer, comprising the steps of:

developing a thin metal plating in a mixed state of diamond grains of plural groups each having different average particle diameters to fix temporarily said diamond grains onto a substrate;

removing floated diamond grains which are not in contact with said substrate; and metal plating to form a predetermined thickness of metal plating.

9. A process for preparing a dressing tool for the surface of an abrasive cloth for use in a mechanochemical polishing process for polishing a semiconductor wafer, comprising the steps of:

developing a thin metal plating in a mixed state of diamond grains and other particles smaller than said diamond grains to fix temporarily said diamond grains and said other particles onto a substrate;

removing floating diamond grains which are not in contact with said substrate; and metal plating to form a predetermined thickness of metal plating.

10. A process for preparing a dressing tool for the surface of an abrasive cloth for use in a mechanochemical polishing process for polishing a semiconductor wafer, comprising the steps of:

opening holes through an insulator plate;

adhering said plate to a substrate; and metal plating selectively on said substrate inside said holes through said plate to fix diamond grains to the substrate only inside said holes, said plate is kept adhered to the substrate.

11. The process for preparing a dressing tool as defined in claim 10, wherein said insulator plate comprises at least one selected from the group consisting of $ZrO_2$, $Al_2O_3$, $Si_3N_4$, cubic boron nitride and hard plastics.

12. A process for preparing a dressing tool for the surface of an abrasive cloth for use in a mechanochemical polishing process for polishing a semiconductor wafer, comprising the steps of:

fixing diamond grains on a substrate by nickel plating; and forming a protective layer on the resultant nickel plating.

13. The process for preparing a dressing tool as defined in claim 12, wherein said protective layer comprises at least one selected from the group consisting of $ZrO_2$, $Al_2O_3$, $Si_3N_4$, cubic boron nitride, pseudo-diamond carbon and diamond.

14. A dressing tool for the surface of an abrasive cloth for use in a mechanochemical polishing process for polishing a semiconductor wafer comprising diamond grains, metal plating and a protective layer covering the metal plating.

15. The dressing tool for the surface of an abrasive cloth as defined in claim 14, wherein said protective layer comprises at least one selected from the group consisting of $ZrO_2$, $Al_2O_3$, $Si_3N_4$, cubic boron nitride, pseudo-diamond carbon and diamond.

16. A dressing tool for dressing a surface of an abrasive cloth, said dressing tool comprising:

diamond grains of an average particle diameter large enough to exhibit dressing work; and a plate thinner than said diamond grains, wherein said diamond grains are contained within said plate.

17. The dressing tool for the surface of an abrasive cloth as defined in claim 16, wherein said plate comprises at least one selected from the group consisting of $ZrO_2$, $Al_2O_3$, $Si_3N_4$ and cubic boron nitride.

18. The dressing tool for the surface of an abrasive cloth as defined in claim 16, wherein said plate has a thickness larger than that of a metal binder that binds said diamond grains and said plate.

* * * * *